US006134838A

United States Patent [19]

Reddy

[11] Patent Number: 6,134,838

[45] **Date of Patent: *Oct. 24, 2000**

[54] POWER DOOR HAVING A DRIVE MEMBER DISPOSED WITHIN A HANGER PORTION AND ROLLERS OF A DOOR SUPPORT ENGAGING THE HANGER PORTION FOR MOTION THEREALONG

[75] Inventor: Redreddy Sukumar Reddy, Evanston, Ill.

[73] Assignee: Westinghouse Air Brake Company, Wilmerding, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/804,779

[22] Filed: Feb. 24, 1997

[51] Int. Cl.[7] ..... E05F 11/34; E05F 11/54

[52] U.S. Cl. ..... 49/362; 49/116; 49/117; 49/118; 49/360

[58] Field of Search ..... 49/116, 117, 118, 49/360, 362

[56] References Cited

U.S. PATENT DOCUMENTS

| | | | |
|---|---|---|---|
| 1,300,782 | 4/1919 | Ryan . | |
| 2,056,174 | 10/1936 | Earhuff et al. | 49/362 X |
| 3,172,651 | 3/1965 | Wilson | 49/360 |
| 3,327,428 | 6/1967 | Horton et al. | 49/360 X |
| 3,670,455 | 6/1972 | Slaybaugh | 49/360 |
| 3,745,705 | 7/1973 | Reddy . | |
| 3,918,201 | 11/1975 | Graziano . | |
| 4,091,570 | 5/1978 | Favrel . | |
| 4,198,786 | 4/1980 | Monot . | |
| 4,503,637 | 3/1985 | Parente | 49/360 X |
| 5,077,938 | 1/1992 | Moreuil . | |
| 5,085,094 | 2/1992 | Clawson et al. | 49/362 X |
| 5,253,452 | 10/1993 | Goldbach | 49/212 |
| 5,341,598 | 8/1994 | Reddy | 49/362 |
| 5,494,093 | 2/1996 | Eiterman | 160/300 |

FOREIGN PATENT DOCUMENTS

| | | | |
|---|---|---|---|
| 90203500 | 2/1992 | European Pat. Off. | 49/360 |
| 888221 | 8/1953 | Germany | 49/362 |
| 411616 | 11/1966 | Switzerland | 49/360 |

*Primary Examiner*—Daniel P. Stodola
*Assistant Examiner*—Gregory J. Strimbu
*Attorney, Agent, or Firm*—James Ray & Associates

[57] ABSTRACT

A power door for a transit vehicle includes a door panel, a base and hanger unit, a door support, a drive member and a motor. The door support is attached to the door panel and includes at least one roller which engages a hanger portion of the base and hanger unit for motion along the base and hanger unit. The hanger portion includes a longitudinal cavity and a slot communicating with the cavity. The drive member is disposed within the cavity and a drive member connector passes through the slot to connect the drive member to the door support.

10 Claims, 9 Drawing Sheets

FIG. 1
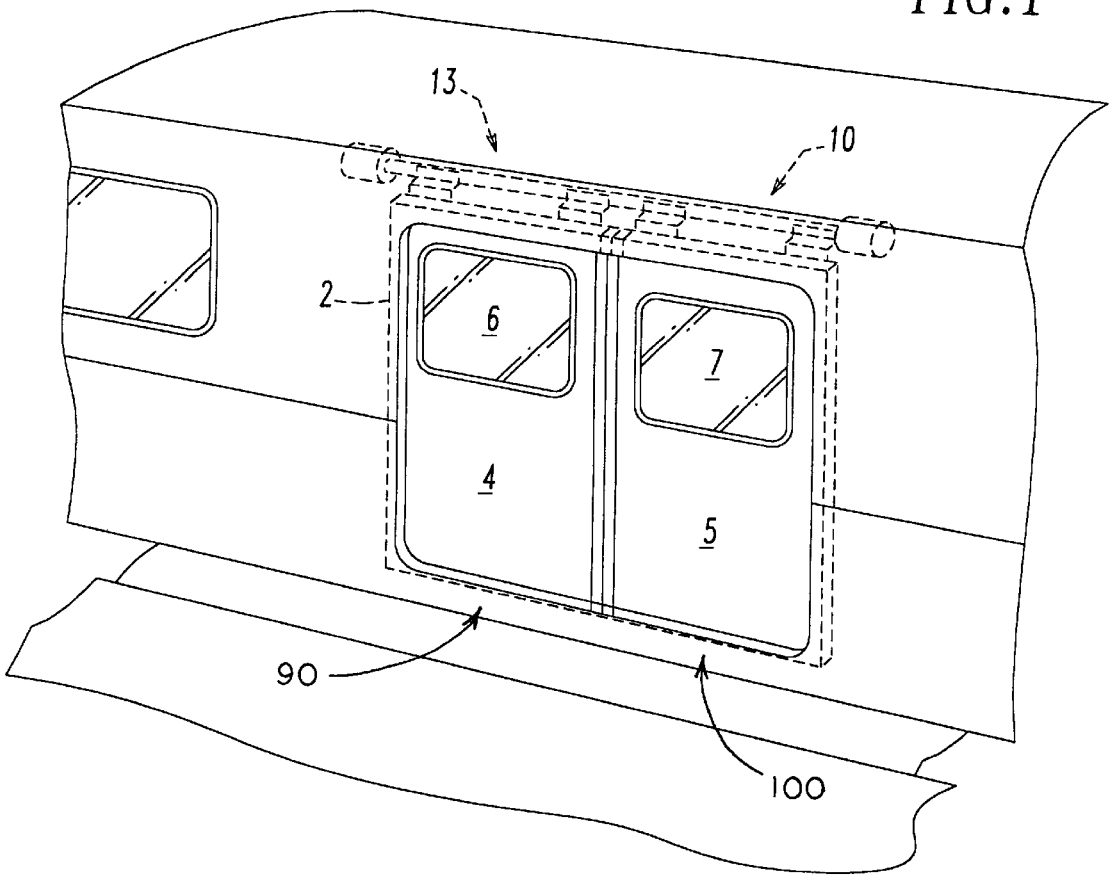
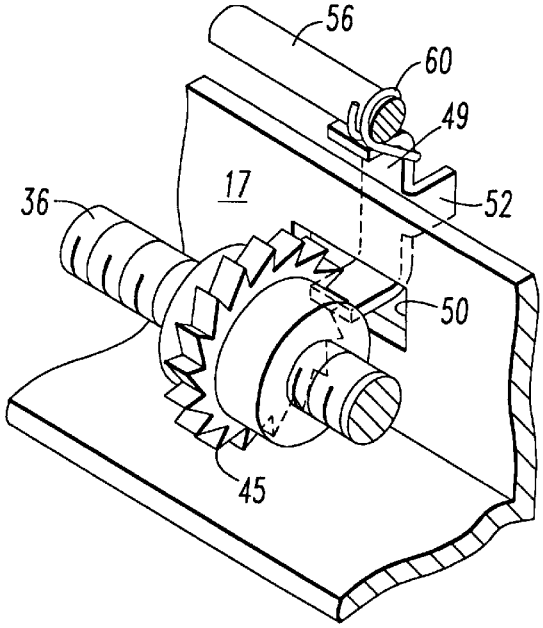
FIG. 3

FIG. 7
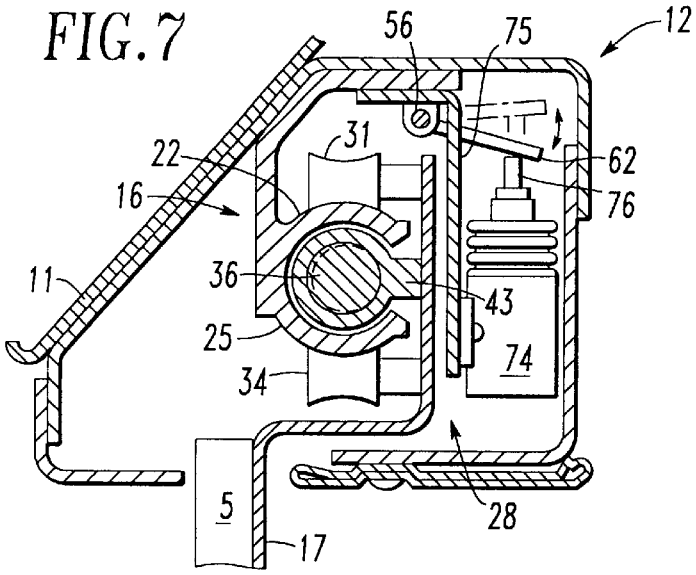
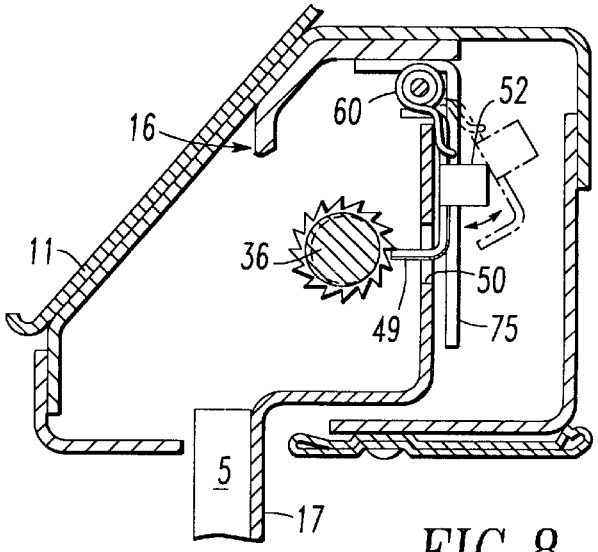
FIG. 8
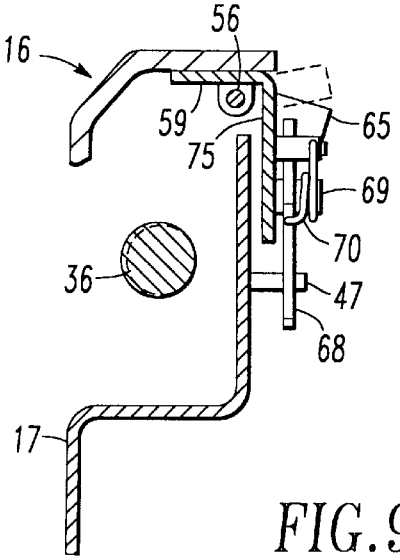
FIG. 9

FIG. 10
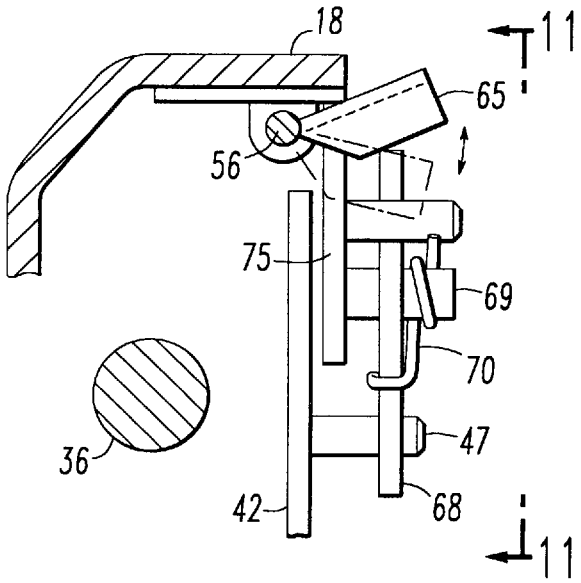
FIG. 11
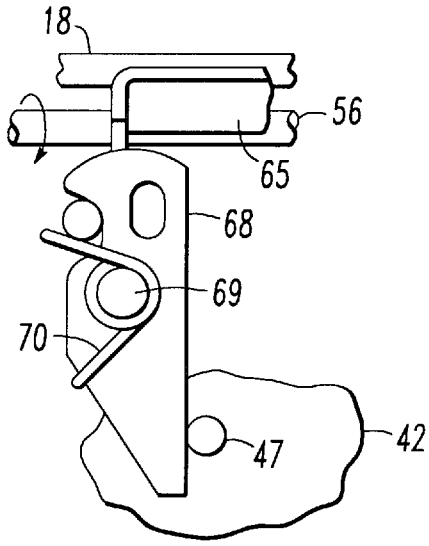
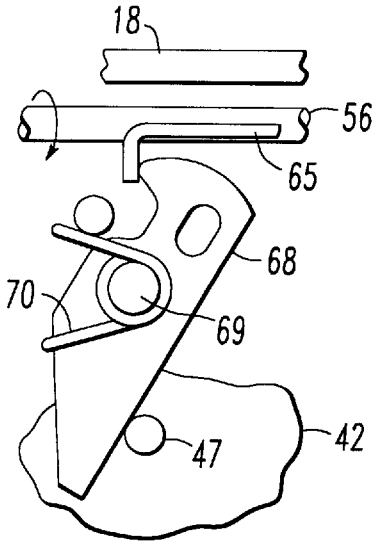
FIG. 13
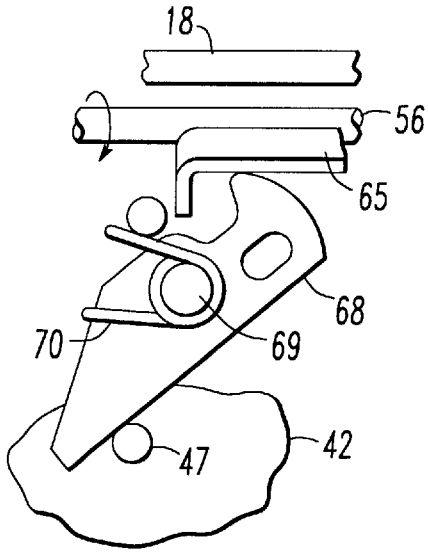
FIG. 15

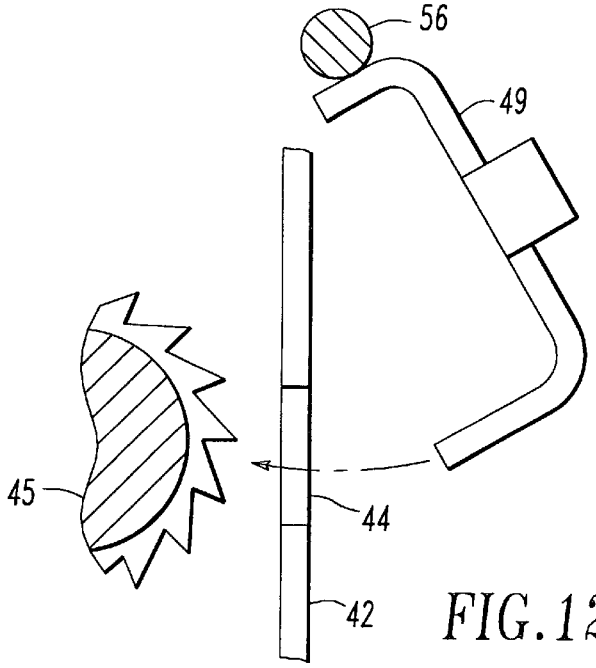
FIG. 12
FIG. 14
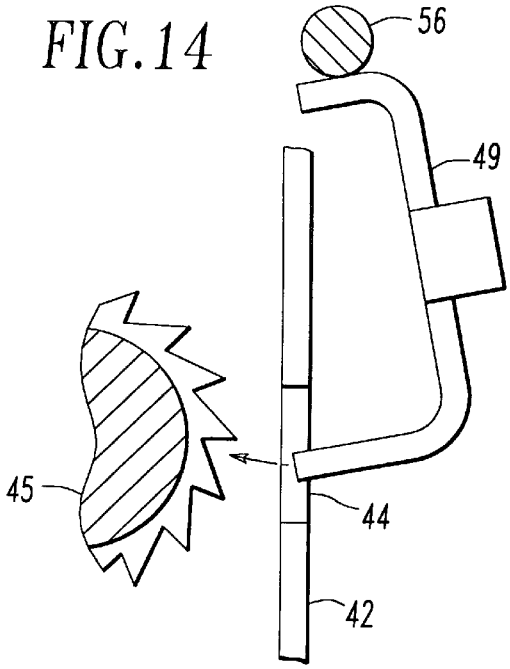
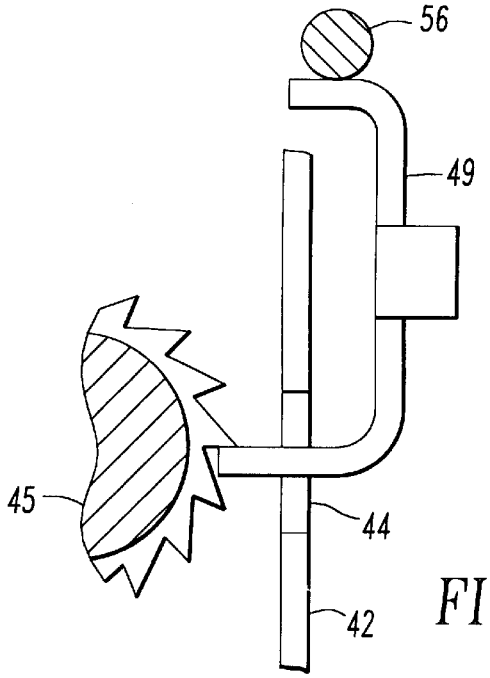
FIG. 16

FIG. 17
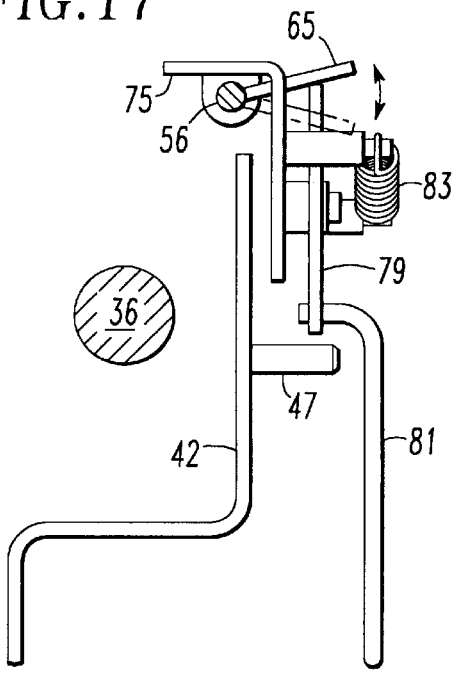
FIG. 18
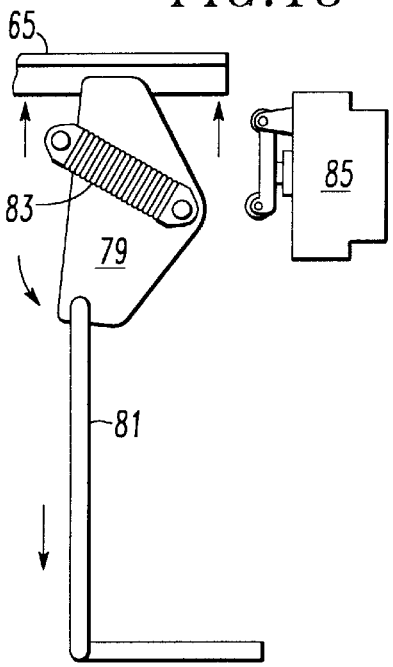
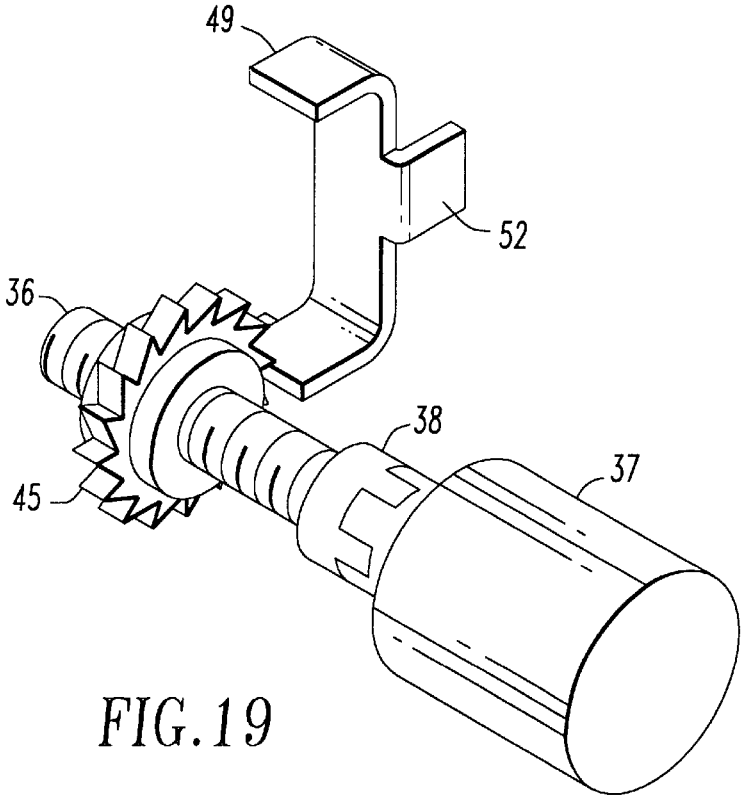
FIG. 19

POWER DOOR HAVING A DRIVE MEMBER DISPOSED WITHIN A HANGER PORTION AND ROLLERS OF A DOOR SUPPORT ENGAGING THE HANGER PORTION FOR MOTION THEREALONG

BACKGROUND OF THE INVENTION

This invention relates generally to car door operators for mass transit vehicles, more particularly concerning operators mounted overhead of a door opening in the vehicular side wall. The invention disclosed herein further relates particularly to power door operators incorporating helical drive/nut components and incorporating independent primary and secondary panel locks through prevention of drive member rotation and direct prevention of panel motion.

Overhead door operators incorporating helical drive members are well known in the field of mass transit door equipment. U. S. Pat. Nos. 3,745,705; 4,198,786; and 5,341,598 disclose overhead operators. All of the above mentioned operators utilize exposed helical door drive and exposed, axially displaced door hangers. In these arrangements there is a substantial force couple generated by offsetting the door drive and door hanger, thereby increasing wear on both the drive nut, hanger and any associated door panel lower guides. In addition, the physical displacement between the drive member and door hanger results in critical limited adjustment of the door panel with regard to motion transverse to the panel plane and hanger axis. Further, the exposed hanger and helical drive/nut combinations are particularly susceptible to contamination present in the application, including wear and dirt particles. Atmospheric corrosion is also a substantial problem.

The invention disclosed herein largely overcomes the difficulties through the use of a coaxial design wherein the helical drive member is disposed internal of and coaxial with a semi-cylindrical door hanger. This arrangement minimizes the force couple generated by the drive member- door panel spacing or offset. In addition, the door hanger utilizes upper and lower plastic rollers operating on the corresponding surfaces of the semi-cylindrical hanger. This arrangement greatly reduces the criticality of transverse door adjustment.

Also, a part of the invention disclosed herein is a greatly simplified door panel lock incorporating a ratchet cam and lock pawl combination which provides unidirectional rotation of the helical member. This allows precision positioning of the panel and prevents back driving the door panel through reverse rotation of the helix. The locking arrangement further includes a projection of the lock pawl through a slot or aperture in the door hanger whereby door panel opening motion due to a failure in engagement of the lock pawl and ratchet cam will be prevented by the continuing presence of the lock pawl in the aforementioned hanger slot. The design, therefore, provides truly independent primary and secondary door panel locks.

Therefore, it is an object of the invention to provide an overhead power door drive having inherent primary and secondary door panel locks.

It is an additional object of the invention to provide a power door drive having coaxial hanger and drive members minimizing door drive/door panel offsets and attendant wear producing forces.

It is a further object of the invention to provide a power overhead door drive wherein the helical drive member is completely contained within a semi-cylindrical hanger, thereby minimizing environmental and atmospheric contamination of the helical drive/nut engagement.

It is a further object of the invention to provide an overhead door drive wherein the coaxial relationship between a helical drive member internal of a semi-cylindrical door hanger utilizing cylindrically concave rollers intermediate the door panel and hanger surface provides simplified adjustment of the driven door panel.

SUMMARY OF THE INVENTION

The door drive disclosed herein includes a base plate mounted overhead of an opening in the side wall of a mass transit vehicle. The base plate includes a semi-cylindrical door panel hanger portion. Mounted internal of the base plate hanger portion is a helical drive including a threaded cylindrical member and cooperating drive nut of the recirculating ball type. The helical drive member is rotated by a rotary prime mover mounted at one end of the base plate. The opposite end of the helical drive member is journaled internal of the hanger portion of the base plate in a cylindrical roller bearing.

The drive nut extends through a longitudinal slot in the hanger portion of the base plate for reciprocal motion therein, on rotation of the rotary prime mover corresponding to said motion. A door bracket affixed to the upper end of a door panel is connected to the above mentioned drive nut extension. The door bracket further includes at least two sets longitudinally disposed vertically oriented pairs of cylindrically concave plastic rollers. The aforementioned vertical orientation provides upper and lower rollers in each pair. In operation, the upper and lower door bracket rollers cooperate with corresponding services in the semi- cylindrical hanger portion of the overhead mounted base plate, thereby providing low friction contamination resistant movement of the door panel when the rotary prime mover is energized and rotates the helical drive member. The combination provides reciprocal travel of the drive nut and attached door panel on the hanger portion of the base plate.

Locking of the door panel in a closed position is accomplished through the use of a ratchet cam rotating on the helical drive member and an associated lock pawl. The lock pawl passes through an aperture in the above-described door bracket, contacting the ratchet cam such that only unidirectional rotation of the cam is allowed with the lock pawl in place. Therefore, with the door panel in a closed and locked position, the lock pawl occupies a position internal of a slot in the door panel bracket. In this condition the lock pawl and ratchet cam prevent rotation of the helical member which would allow panel movement in an opening direction on back driving of the drive nut and helical member. However, since the position of the lock pawl in the door panel bracket slot is independent of lock pawl/ratchet cam engagement, movement of the door panel in an opening direction should said engagement fail, continues to be prevented.

The above described combination of lock pawl/ratchet cam and location of the lock pawl provide separate and distinct primary and secondary locks for the door panel in that a failure of the ratchet cam/lock pawl engagement or other failure allowing rotation of the helical drive member with attendant motion in the opened direction of the door panel is prevented by the presence of the lock pawl in the door bracket slot.

BRIEF DESCRIPTION OF THE DRAWINGS

Other objects and advantages of the invention will become apparent upon reading the following detailed description and upon reference to the drawings in which:

FIG. 1 is a partial perspective view of a typical transit car body, particularly showing location of the operators of the invention in place overhead of reciprocating car door panels;

FIG. 3 is a partial perspective view of the lock pawl and ratchet cam utilized in the invention, and, as indicated in the dashed circle of FIG. 2 and identified by numeral 3;

FIG. 7 is a section of the operator of the invention along the lines 7—7 of FIG. 6;

FIG. 8 is a section of the operator of the invention along the lines 8—8 of FIG. 6;

FIG. 9 is a section of the operator of the invention along the lines 9—9 of FIG. 6;

FIG. 10 is a partial section of the operator of the invention particularly showing end view of the lock and unlock cams;

FIG. 11 is a view along the lines 11—11 of FIG. 10, particularly showing a plan view of the lock cam and lock shaft of the invention;

FIG. 12 is an additional partial section of the lock assembly of the invention, particularly showing the position of a lock pawl in an unlocked position;

FIG. 13 is a partial plan view of the lock assembly of the invention, particularly showing the lock shaft pawl and lock cam with the door in a partially closed position;

FIG. 14 is a partial section of the lock assembly of the invention corresponding to the door position of FIG. 13;

FIG. 15 is a partial plan view of the lock assembly of the invention, particularly showing the door in a fully closed position;

FIG. 16 is an additional partial section of the lock assembly of the invention with the panel as shown in FIG. 15;

FIG. 17 is a partial section of the invention, particularly showing the manual unlocking assembly of the invention, particularly showing the lock shaft in a manually unlocked position;

FIG. 18 is an additional plan view of the manual unlock assembly of FIG. 17; and FIG. 19 is a partial perspective view of the drive system of the invention, particularly showing the rotary drive member, shaft coupler between the rotary prime mover and the helical drive member and the lock pawl/ratchet cam in engagement.

Figure 2:
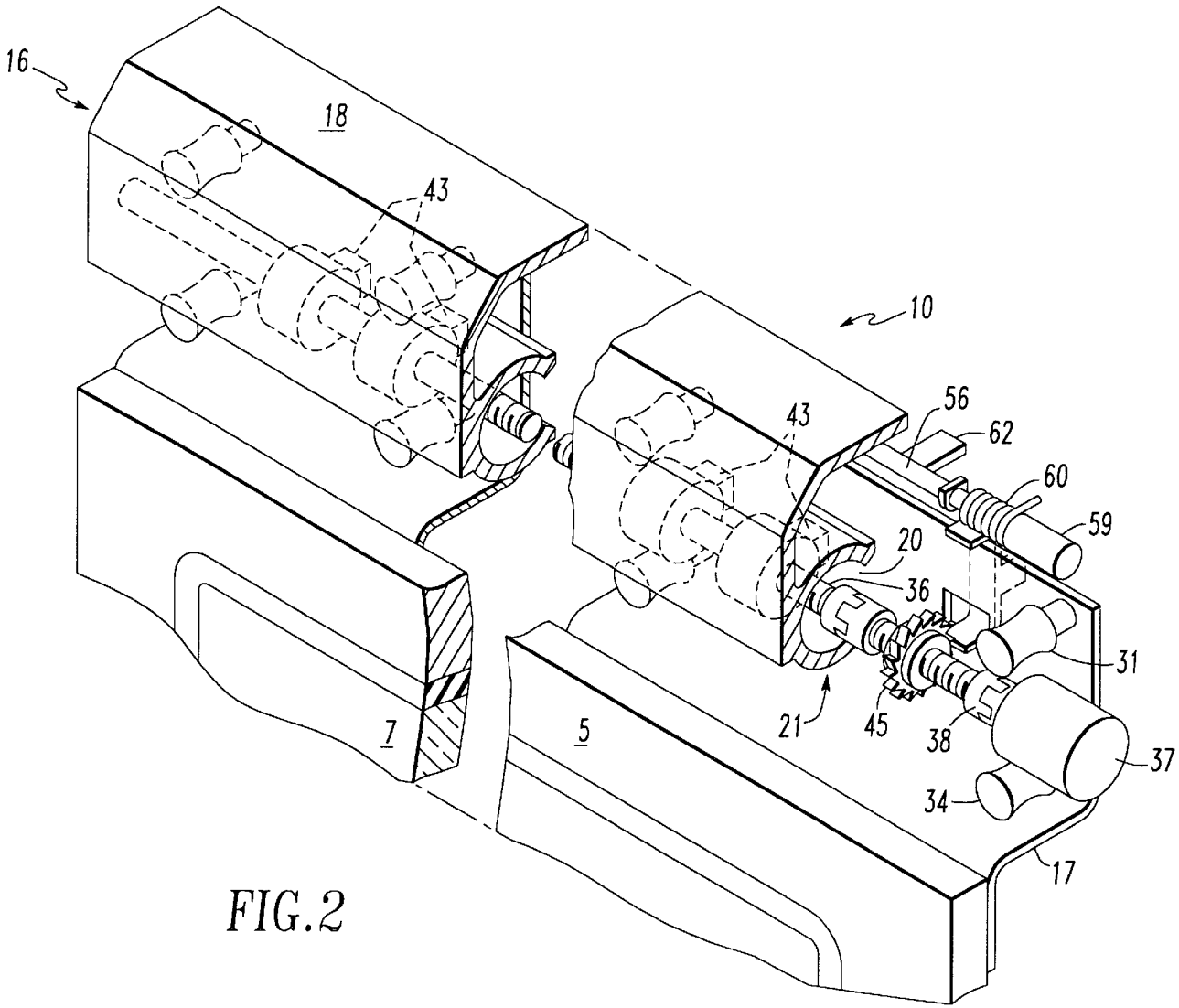
FIG. 2 is a partial perspective view of one operator shown in FIG. 1, particularly showing location of the door panels, and other operative components of the power door drive through cut-away views.

While the novel concentric overhead power door actuator of the invention will be described in connection with a preferred embodiment and a single alternate embodiment, it will be understood that it is not intended to limit the invention to those embodiments. On the contrary, it is intended to cover all alternatives, modifications and equivalents that may be included within the spirit and scope of the invention disclosed and defined by the appended claims.

DETAILED DESCRIPTION OF OPERATION

With respect to FIG. 1, there is shown a partial view of a "typical" transit vehicle 1 having door opening 2. It has a power door, generally designated 90, consisting of door panel 4 driven by operator 13 and having window 6. It also has a power door, generally designated 100, consisting of door panel 5 powered by operator 10 and having window 7. Bi-parting door panels 4 and 5 are for reciprocal motion over and away from an opening 2 in transit vehicle 1.

Mounted overhead of door panels 4 and 5, operators 10 and 13 provide the above-mentioned reciprocal motion. As operators 10 and 13 are identical, the following description will be concerned with operator 13 as those skilled in the art will readily understand that operation of operator assembly 10 is identical other than the direction of motion.

Operator 13 includes an integral base and hanger unit 16 having a base portion 18 and a hanger portion 21. Hanger portion 21 includes an internal cavity 23 and a longitudinal slot 20. Surrounding the internal cavity 23 of the hanger portion 21 there are upper and lower hanger surfaces 22 and 25, respectively. Hanger surfaces 22 and 25, preferably, are convex.

As shown in FIGS. 7 and 8, the base and hanger unit 16 mounts in housing 12 attached to car member 11. In the presently preferred embodiment shown, drive member 36 is a helical drive member rotatably mounted in cavity 23 using drive motor 37 at one end coupled to helical drive member 36 via coupler 38. The distal end of helical drive member 36 is supported by outboard cylindrical roller bearing 39 journaled internal of the cavity 23 (not shown). In the presently preferred embodiment, drive nut 40 (Reference FIG. 5) is of the well known recirculated "ball nut type" mounted on drive member 36 for reciprocal motion along said drive member 36 on rotation thereof.

Preferably, hanger surfaces 22 and 25 are semi-cylindrical surfaces which are concentric with helical drive member 36. The term "semi-cylindrical surface" is herein employed to refer to a surface which is a portion of a cylindrical surface.

The cavity 23 of hanger portion 21 of the base and hanger unit 16 further includes a longitudinal slot 20. Drive nut 40 includes a protrusion 43 extending through the slot 20. Protrusion 43 is affixed to the panel bracket 17 portion of hanger assembly 28.

Figure 5:
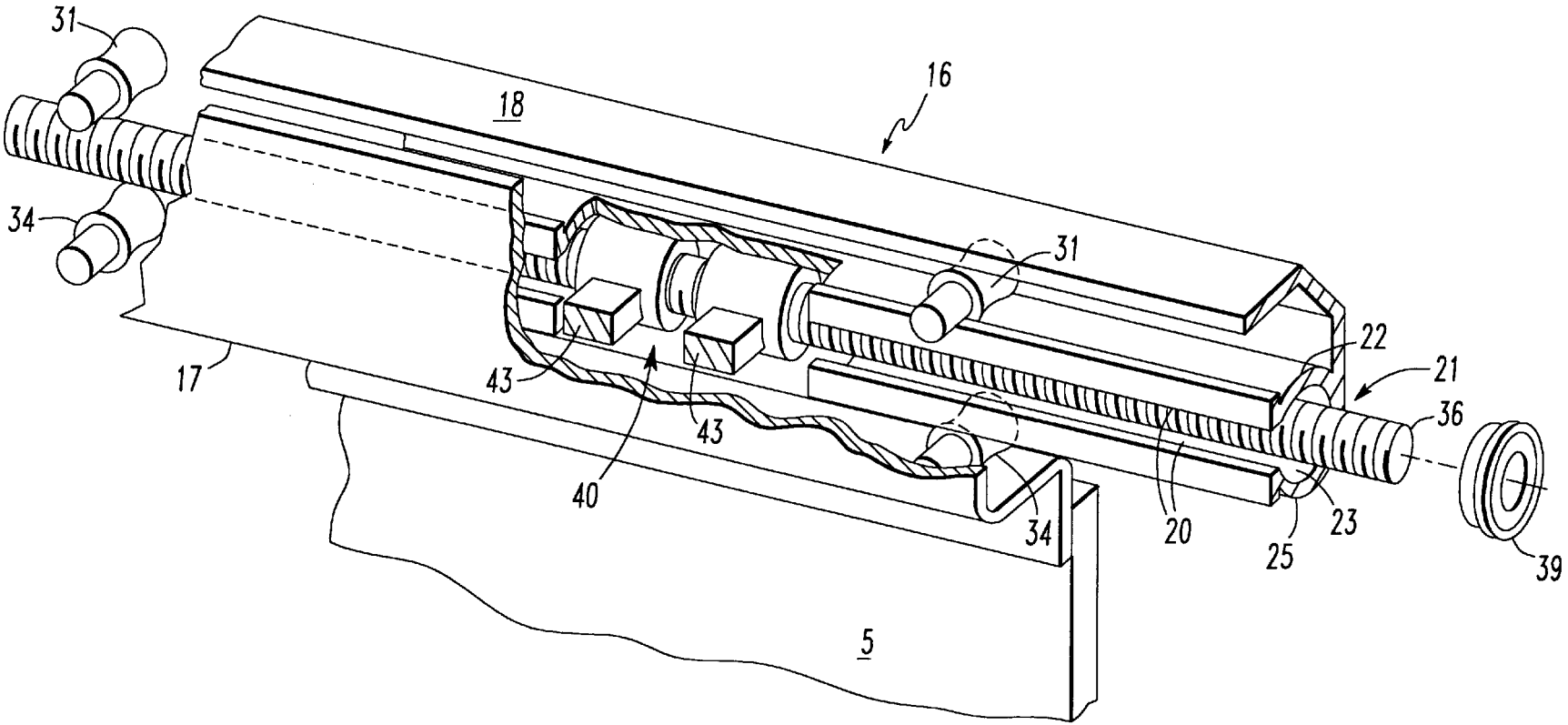
FIG. 5 is a further partial perspective view of the operator of the invention including a tearaway view of the drive member and drive nut, and particularly showing the opposite side of the operator of FIG. 2.

Turning now to FIGS. 2, 5 and 7, the hanger assembly 28 carrying the door panel 4 includes upper rollers 31 and lower rollers 34 rotatably attached to the panel bracket 17. Rollers 31 and 34 cooperate with surfaces 22 and 25 in providing motion along the hanger portion 21 of base and hanger unit 16.

Protrusion 43 of drive nut 40 extends through slot 20 and is attached to panel bracket 17 intermediate the attachment points of rollers 31 and 34 (Reference FIGS. 5 and 7). Motion of drive nut 40 attached to door bracket 17 via protrusion 42 moves the door panel 4 on rotation of helical member 36.

Figure 4:
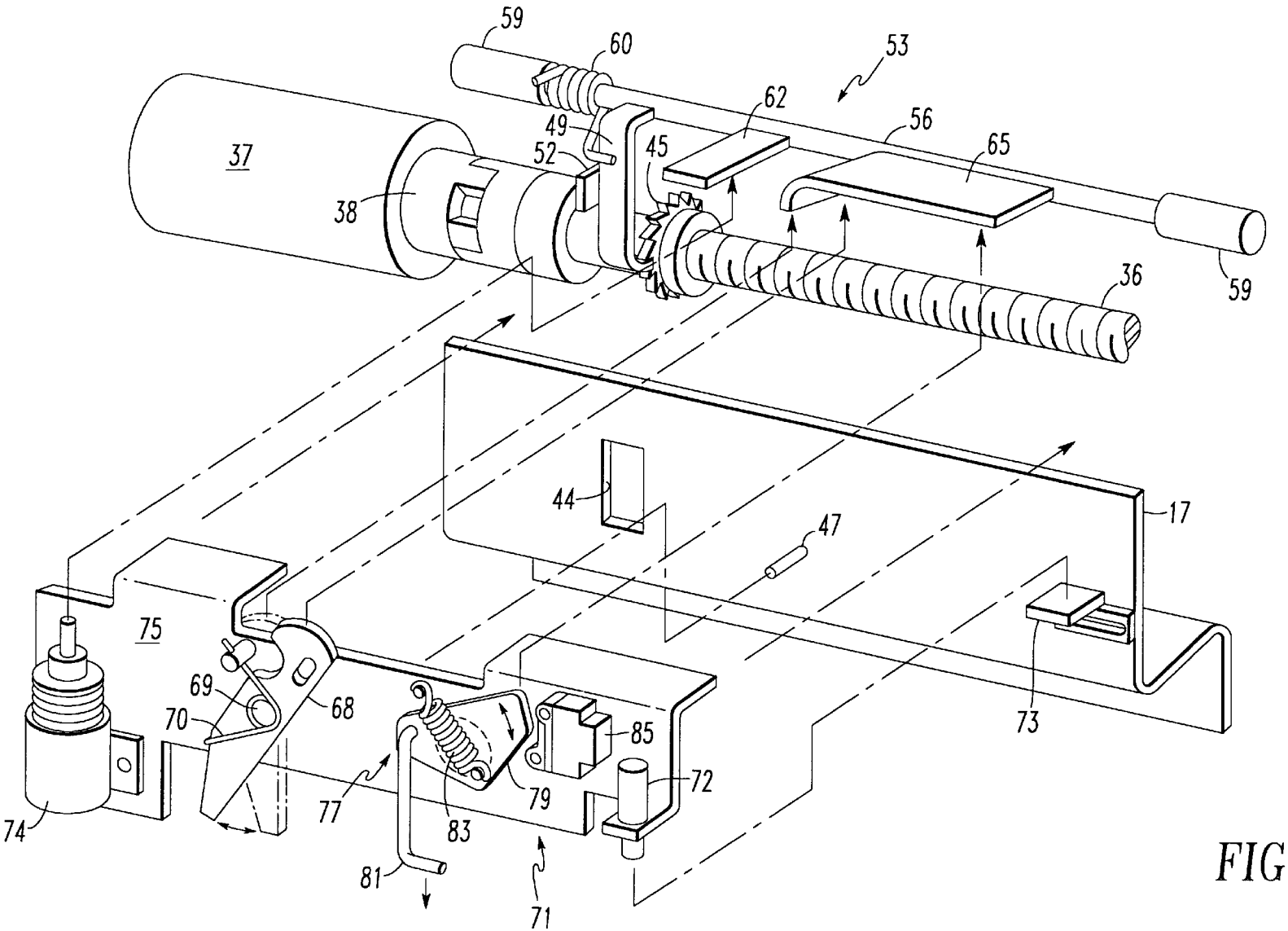
FIG. 4 is an exploded view of the drive members, lock shaft, lock panel, and door bracket of the invention.
Figure 6:
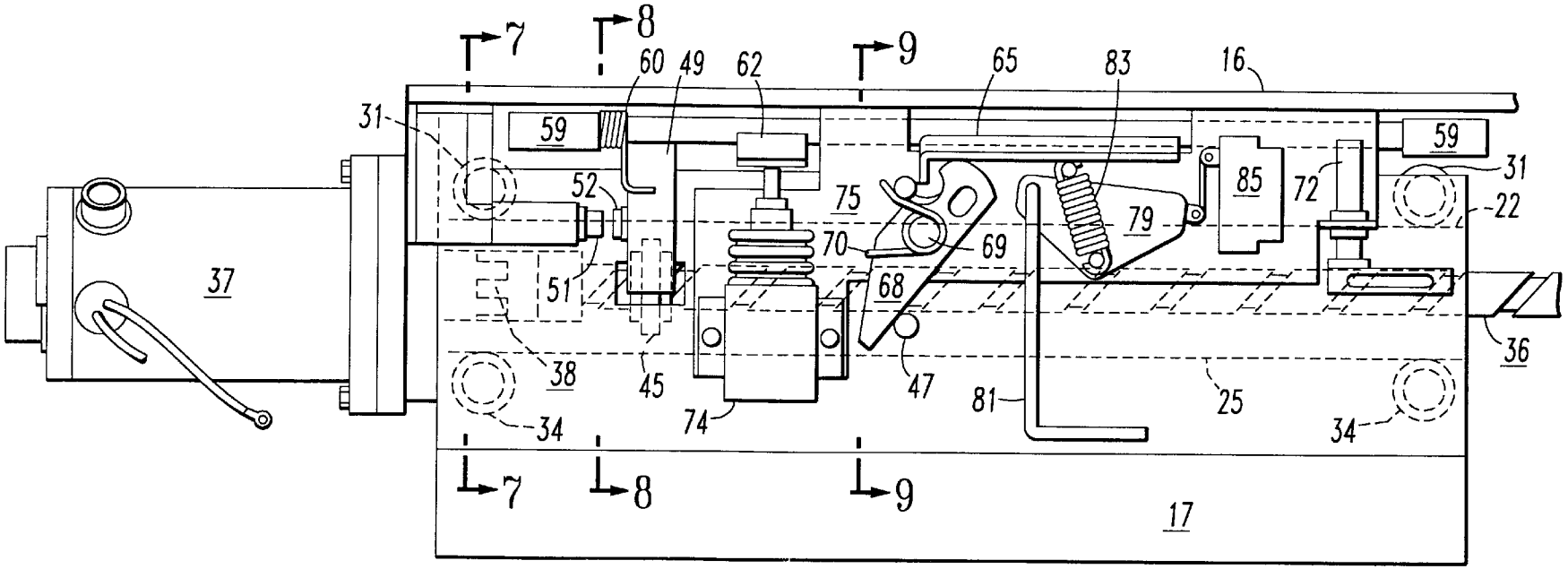
FIG. 6 is a partial plan view of the operator of the invention, particularly showing the lock shaft and lock members.

In further reference to FIGS. 4 and 6, lock shaft assembly 53 is rotatably attached to the internal surface of the base portion 18 of base and hanger unit 16. Mounting of assembly 53 is accomplished by journaling the shaft 56 in journals 59 for rotatably motion therein. Also attached to shaft 56 is lock pawl 49, unlock tab 62, and lock cam 65, as shown. The shaft 56 is maintained in a counterclockwise position by torsion spring 60. The combination of spring 60 and lock pawl 49 when occupying slot 44 in hanger 17, cooperating with ratchet 45, provide unidirectional rotation of helical drive member 36, thereby preventing clockwise rotation of helical drive member 36. Operation of ratchet wheel 45 and lock pawl 49 could be achieved through use of a unidirectional clutch.

Also attached to the upper inner surface of base portion 18 of base and hanger unit 16 is lock panel assembly 71 including lock panel 75 (Reference FIGS. 4 and 7). In position, lock panel 75 carries unlock solenoid 74, lock cam 68, panel sensor 72 and manual unlock assembly 77. The operation of this panel will be described further in substantial detail.

In operation, rotation of helical drive member 36 by drive motor 37 moves drive nut 40 in a direction dependent on the rotation of drive member 36. The following description will assume that the door panel is in a closed and locked position, as shown in FIG. 6. Operation of the novel lock shaft configuration 53 is best seen with reference to FIGS. 10 through 16.

In the closed and locked position, lock cam 68 biased by spring 70 has allowed lock shaft 56 to assume a somewhat counterclockwise position wherein lock pawl 49 and ratchet 45 are in a condition shown in FIGS. 3, 5 and 16, whereby further rotation in a clockwise (door opening) direction is prevented by the interaction of ratchet wheel cam 45 and lock pawl 49. Lock pawl 49, lodged in aperture 44 in door hanger 17, further prevents motion of door panel 5. As shown in FIGS. 15 and 16, lock cam 68 pivoted at 69 is biased counterclockwise by spring 70. With the pin 42 in a door closed position, cam 68 and lock shaft cam 65 are disengaged (Reference FIG. 15).

On receipt of a door open command, solenoid 74 is energized raising the solenoid plunger 76, contacting tab 62, thereby rotating shaft 56 in a counterclockwise direction, as shown in FIG. 10. Rotation of shaft 56 raises cam 65, thereby withdrawing lock pawl 49 from slot 50 in panel bracket 17 (Reference FIG. 12). Separation of lock pawl 49 and ratchet wheel 45 unlocks the ratchet wheel 45, allowing helical drive member 36 to rotate in a clockwise direction. The position of lock pawl 49 is sensed by projection 52 and sensor 51, thereby energizing drive motor 37, rotating helical drive member 36 in a clockwise direction. Rotation of drive member 36 moves drive nut 40 and door panel 5 to an opened position.

Operation from a fully opened position to closed and locked proceeds as follows:

With particular reference to FIGS. 10 through 16.

With the door in a fully opened position, cam 68 is in the position shown in FIG. 11 wherein cam 68 has contacted lock cam 65, thereby rotating lock shaft 56 counterclockwise. In this condition, lock pawl 49 is rolled out of engagement with ratchet wheel 45 and outside of slot 50 as shown in FIG. 12.

To initiate a closing cycle, drive motor 37 rotates helical drive member 36 in a clockwise direction thereby moving door bracket 42 toward the fully closed position. When pin 47 attached to bracket 42 reaches the lower portion of lock cam 68, lock elements are as shown in FIG. 11. Further movement of lock pin 47 rotates lock cam 68 in a clockwise direction due to the novel spatial relationship between lock pawl 49, lock shaft cam 65 and hanger slot 44, as signaled by panel sensing switch 72, and panel bracket 73, motion of door panel bracket aligns slot 44 and lock pawl 49. Rotation of lock shaft 56 simultaneously allows lock pawl 49 to enter slot 44, and engage ratchet wheel 45. At this point, both the primary lock, i.e., lock pawl 49 and ratchet wheel 45, and the secondary lock, i.e., lock pawl 49 in slot 44, are engaged, as shown in the progression of FIGS. 13, 14, 15 and 16. Movement of lock pawl 49 into slot 50 is detected by sensor 51 as is the location of panel bracket 42 by sensor 72 and tab 73.

Those skilled in the art will readily see that with the lock pawl 49 in slot 50 and held against ratchet wheel 45, the door panel 5 is held in a closed position, requiring two consecutive failures, i.e., a failure of the ratchet wheel 45 and lock pawl 49 acting in slot 50 to allow unauthorized door opening. This novel approach provides primary and secondary door panel locks in a single package, providing an extraordinarily high level of reliability in the locked position.

Operation of the manual unlocking assembly 77 proceeds as follows. With the door in the above described closed and locked position, in the case of loss of power, manual unlocking is achieved by downward force on lever 81, thereby rotating cam 79 against toggle spring 83. Rotation of manual unlock cam 79 in a counterclockwise direction contacts unlock cam 65, rotating shaft 56, thereby moving lock pawl 49 out of engagement with ratchet wheel 45 and slot 50 in hanger bracket 17. At this point, the door can manually be moved to an opened position.

Thus, it is apparent that there has been provided in accordance with the invention a linear overhead power door operator having a semi-cylindrical hanger and an internally mounted coaxial door drive member that fully satisfies the objects, aims and advantages as set forth above. While the invention has been described in conjunction with a specific embodiment thereof, it is evident that many alternatives, modifications, and variations will be apparent to those skilled in the art in light of the foregoing description. Accordingly, it is intended to embrace any and all such alternatives, modifications and variations as may fall within the spirit and broad scope of the appended claims.

What is claimed as new and desired to be secured by Letters Patent of the United States is:

1. A power door for covering and uncovering a door opening in a transit vehicle, said power door comprising:

a door panel;

a base and hanger unit having a base portion attachable overhead of said door opening in said transit vehicle;

a door support on said door panel, said door support extending above said door panel and adjacent to a hanger portion of said base and hanger unit, said door support having at least one roller engaging said hanger portion of said base and hanger unit for motion along said base and hanger unit;

a longitudinal cavity in said hanger portion of said base and hanger unit;

a slot communicating with said longitudinal cavity;

a drive member disposed longitudinally in said cavity;

a motor connected to said drive member to power said drive member; and a drive member connector engaging said drive member to be moved by said drive member, said drive member connector passing through said slot, said drive member connector being attached to said door support.

2. A power door according to claim 1 wherein said drive member is a helical drive member and said drive member connector includes a drive nut, said drive nut engaging said helical drive member to be driven by said helical drive member upon rotation of said helical drive member by said motor.

3. A power door according to claim 2 wherein said drive nut is a recirculated ball drive nut.

4. A power door according to claim 2 further including a coupler disposed between said motor and said helical drive member.

5. A power door according to claim 1 wherein said at least one roller is two pair of rollers engaging upper and lower surfaces of said hanger portion of said base and hanger unit.

6. A power door according to claim 5 wherein said rollers are concave and said upper and lower surfaces of said hanger portion of said base and hanger unit are convex.

7. A power door according to claim 6 wherein said upper and lower surfaces of said hanger portion of said base and hanger unit are substantially semi cylindrical.

8. A power door according to claim 7 wherein said drive member is substantially concentric with said substantially semi cylindrical surfaces of said base and hanger unit.

9. A power door according to claim 1, wherein said cavity is substantially cylindrical.

10. A power door according to claim 9, wherein said drive member is a helical drive member and said cavity is substantially concentric with said helical drive member.

* * * * *